US008659488B2

(12) United States Patent
Tsai et al.

(10) Patent No.: US 8,659,488 B2
(45) Date of Patent: Feb. 25, 2014

(54) ANTENNA ASSEMBLY TO REDUCE SPECIFIC ABSORPTION RATE

(75) Inventors: Tiao-Hsing Tsai, New Taipei (TW); Chi-Yin Fang, Pingtung (TW); I-Ping Yen, New Taipei (TW); Chao-Hsu Wu, Luzhu Township, Taoyuan County (TW); Chun-Yuan Wang, Tainan (TW)

(73) Assignee: Quanta Computer Inc., Tao Yuan Shien (TW)

( * ) Notice: Subject to any disclaimer, the term of this patent is extended or adjusted under 35 U.S.C. 154(b) by 182 days.

(21) Appl. No.: 13/421,890

(22) Filed: Mar. 16, 2012

(65) Prior Publication Data

US 2013/0033411 A1 Feb. 7, 2013

(30) Foreign Application Priority Data

Aug. 2, 2011 (TW) ..... 100127391 A

(51) Int. Cl.
*H01Q 1/24* (2006.01)
*H01Q 9/38* (2006.01)

(52) U.S. Cl.
USPC ..... 343/702; 343/830

(58) Field of Classification Search
USPC ..... 343/702, 830, 700 MS, 846
See application file for complete search history.

(56) References Cited

U.S. PATENT DOCUMENTS

| | | | | |
|---|---|---|---|---|
| 6,847,329 | B2 * | 1/2005 | Ikegaya et al. | 343/702 |
| 7,498,992 | B2 * | 3/2009 | Hung et al. | 343/702 |
| 8,502,747 | B2 * | 8/2013 | Chang et al. | 343/822 |

* cited by examiner

*Primary Examiner* — Hoang V Nguyen
(74) *Attorney, Agent, or Firm* — Nixon & Vanderhye P.C.

(57) ABSTRACT

An antenna assembly includes first and second antennas each generating a resonant mode to cover an operating bandwidth, and a transmission line. The first includes a first radiation unit with a feed-in portion coupled to a first feed portion in contact with a core wire of a coaxial cable and a first grounding portion. The second antenna includes a second radiation unit with a second feed-in portion coupled to a second feed portion in contact with a conductive shielding layer of the coaxial cable and a second grounding portion. The transmission line includes first and second connecting portions coupled respectively to the second feed portion of the second feed-in portion. When a signal within the operating bandwidth is transmitted through the coaxial cable, the energy of the signal is distributed among the first and second antennas.

11 Claims, 7 Drawing Sheets

ANTENNA ASSEMBLY TO REDUCE SPECIFIC ABSORPTION RATE

CROSS-REFERENCE TO RELATED APPLICATION

This application claims priority to Taiwanese Application No. 100127391, filed on Aug. 2, 2011.

BACKGROUND OF THE INVENTION

1. Field of the Invention

The invention relates to an antenna assembly, more specifically to an antenna assembly able to reduce specific absorption rate.

2. Description of the Related Art

FIG. 1 shows a conventional single-band inverted F antenna 10. The inverted F antenna 10 has a grounding portion 11 that includes an edge 111, a radiation unit 12 and a coaxial cable 13.

The edge 111 defines a border line (L). The radiation unit 12 is disposed substantially at one side of the border line (L) opposite to the grounding portion 11, and includes a first radiation arm 121 and a second radiation arm 122. The first radiation arm 121 has a free end 1211 and a feed-in portion 1212. The second radiation arm 122 has a short circuit portion 1221 electrically coupled to the edge 111 of the grounding portion 11 and a connecting portion 1222 electrically coupled to the first radiation arm 121.

The coaxial cable 13 includes a core wire 131 that has an end portion 1311, and a conductive shielding layer 132. The end portion 1311 is electrically coupled to the feed-in portion 1212, and the conductive shielding layer 132 is electrically coupled to the grounding portion 11.

When a signal is sent through the coaxial cable 13 to the inverted F antenna 10, the energy of the signal is radiated outwardly through the radiation unit 12, making it easy for the specific absorption rate (SAR) of an area 9 in the vicinity of the radiation unit 12 to break regulations.

SUMMARY OF THE INVENTION

Therefore, an object of the present invention is to provide an antenna assembly able to reduce the specific absorption rate.

The antenna assembly of the present invention includes a feed unit, a first antenna, a second antenna and a transmission line.

The feed unit includes a coaxial cable that includes a core wire and a conductive shielding layer, and a first feed portion and a second feed portion that are spaced apart from each other. The first feed portion is in contact with the core wire, and the second feed portion is in contact with the conductive shielding layer.

The first antenna is used to generate a first resonant mode to cover an operating bandwidth and includes a first radiation unit and a first grounding portion. The first radiation unit includes a first feed-in portion electrically coupled to the first feed portion of the feed unit. The first grounding portion is electrically coupled to the second feed portion of the feed unit.

The second antenna is used to generate a second resonant mode to cover the operating bandwidth and includes a second radiation unit and a second grounding portion. The second radiation unit includes a second feed-in portion.

The transmission line includes a first connecting portion and a second connecting portion. The first connecting portion is electrically coupled to the first feed portion of the feed unit, and the second connecting portion is electrically coupled to the second feed-in portion of the second antenna.

Whereby, when a signal within the operating bandwidth is transmitted through the coaxial cable, the energy of the signal is distributed among the first and second antennas.

Another object of the present invention is to provide an antenna assembly able to reduce the specific absorption rate and able to be used in signal transmission with a system circuit through a coaxial cable.

Therefore, the antenna assembly of the present invention includes a first antenna, a second antenna, and a transmission line.

The first antenna is used to generate a first resonant mode to cover an operating bandwidth and includes a first radiation unit and a first grounding portion. The first radiation unit includes a first feed-in portion to be electrically coupled to an end of a core wire of a coaxial cable. The first grounding portion is to be electrically coupled to a conductive shielding layer of the coaxial cable.

The second antenna is used to generate a second resonant mode to cover the operating bandwidth and includes a second radiation unit and a second grounding portion. The second radiation unit includes a second feed-in portion.

The transmission line includes a first connecting portion and a second connecting portion. The first connecting portion is electrically coupled to the first feed-in portion of the first antenna, and the second connecting portion is electrically coupled to the second feed-in portion of the second antenna.

Whereby, when a signal within the operating bandwidth is transmitted through the coaxial cable, the energy of the signal is distributed among the first and second antennas.

The effect of the present invention is that the energy of the transmitted signal is not merely gathered at the first antenna, but distributed among the first antenna and the second antenna, such that the specific absorption rate of the antenna assembly can be reduced.

BRIEF DESCRIPTION OF THE DRAWINGS

Other features and advantages of the present invention will become apparent in the following detailed description of the three preferred embodiments with reference to the accompanying drawings, of which.

DETAILED DESCRIPTION OF THE PREFERRED EMBODIMENTS

Figure 1:
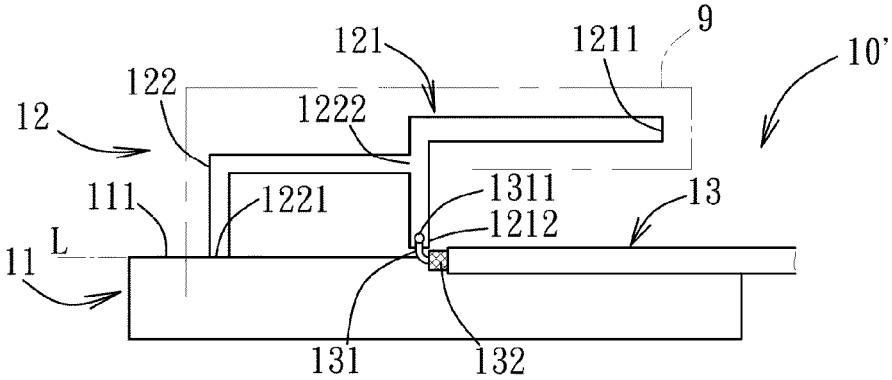
FIG. 1 is schematic drawing of a conventional single-band inverted F antenna.

Before the present invention is described in greater detail, it should be noted that like elements are denoted by the same reference numerals throughout the disclosure.

Figure 2:
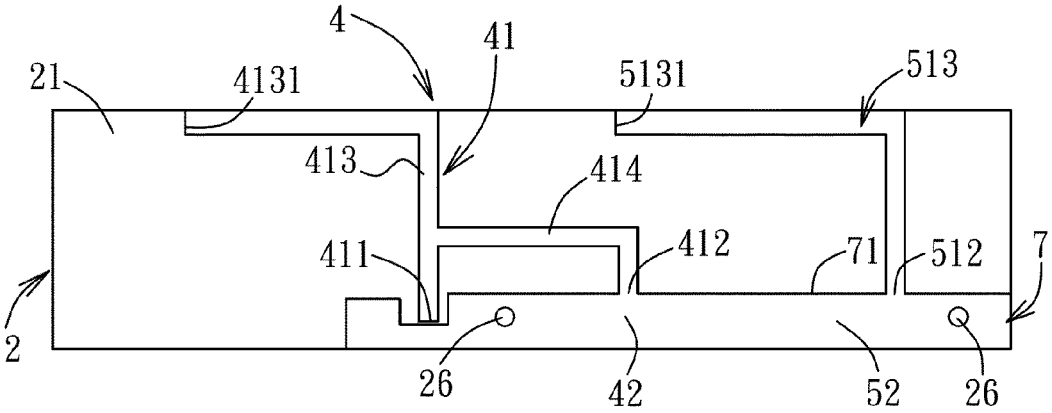
FIG. 2 is a schematic drawing of a first surface of a substrate of the first preferred embodiment of an antenna assembly according to the present invention.
Figure 3:
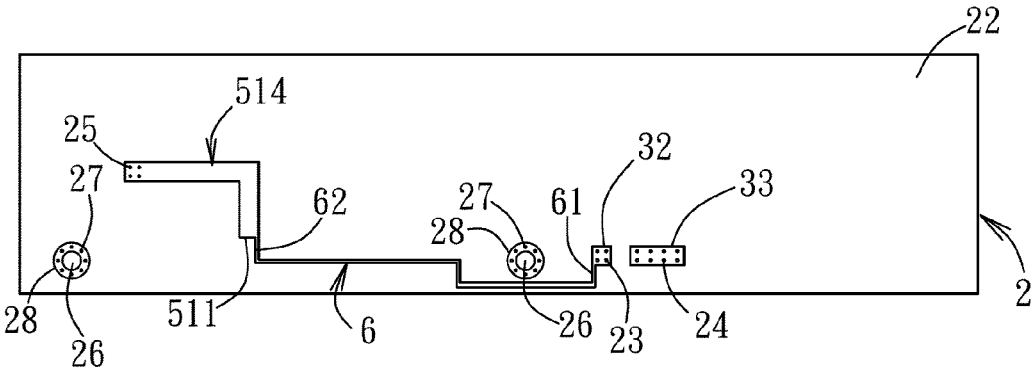
FIG. 3 is a schematic drawing of a second surface of the substrate of the first preferred embodiment.
Figure 4:
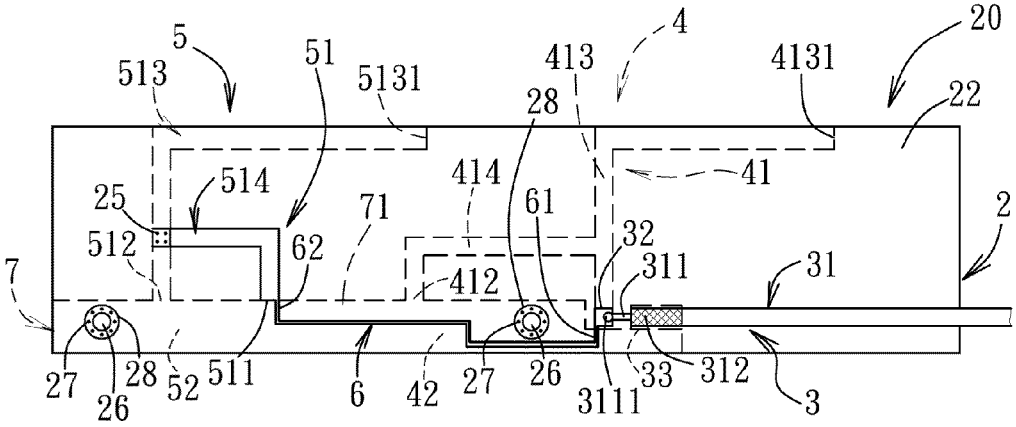
FIG. 4 is a schematic drawing of the substrate of the first preferred embodiment, illustrating the inclusion of a coaxial cable in the first preferred embodiment.

FIGS. 2 to 4 show the first preferred embodiment of an antenna assembly 20 that is able to reduce specific absorption rate according to the present invention. The antenna assembly 20 includes a substrate 2, a feed unit 3, a first antenna 4, a second antenna 5 and a transmission line 6.

The substrate 2 is made of a non-conductive material that may be fibre glass. The substrate 2 includes opposite first and second surfaces 21, 22, a plurality of first conductive vias 23, a plurality of second conductive vias 24, a plurality of third conductive vias 25, a plurality of fastening holes 26, multiple groups of fourth conductive vias 27 respectively corresponding to the fastening holes 26, and a plurality of metal rings 28 respectively corresponding to the fastening holes 26. Each of the first, second, third and fourth conductive vias 23, 24, 25, 27 extends through the first and second surfaces 21, 22.

The feed unit 3 includes a 50-ohm coaxial cable 31 that includes a core wire 311 having an end 3111 and a conductive shielding layer 312, and a first feed portion 32 and a second feed portion 33 that are disposed on the second surface 22 of the substrate 2 and that are spaced apart from each other. The first feed portion 32 is soldered to the end 3111 of the core wire 311, and the second feed portion 33 is soldered to the conductive shielding layer 312.

The first antenna 4 is used to generate a first resonant mode to cover a personal communication service (PCS) 900 operating bandwidth (1850 to 1990 MHz), and includes a first radiation unit 41 and a first grounding portion 42 disposed on the first surface 21 of the substrate 2. The first radiation unit 41 includes a first feed-in portion 411, a first short circuit portion 412, a first radiation arm 413 and a second radiation arm 414 all disposed on the first surface 21 of the substrate 2. The first short circuit portion 412 is electrically coupled to the first grounding portion 42. The first radiation arm 413 extends from the first feed-in portion 411 away from the first grounding portion 42 and has a free end 4131. The second radiation arm 414 extends from the first short circuit portion 412 away from the first grounding portion 42, and is electrically coupled to the first radiation arm 413. The first feed-in portion 411, which is disposed on the first surface 21, is electrically coupled to the first feed portion 32 of the feed unit 3, which is disposed on the second surface 22, through the first conductive vias 23. The first grounding portion 42, which is disposed on the first surface 21, is electrically coupled to the second feed portion 33 of the feed unit 3, which is disposed on the second surface 22, through the second conductive vias 24. By rearranging the position of a junction between the second radiation arm 414 and the first radiation arm 413, an input resistance $R_1$ of the first antenna 4 measured from the first feed-in portion 411 can be adjusted. In the first preferred embodiment, the input resistance $R_1$ is set to be substantially double of the resistance of the coaxial cable 31 (i.e. 100 ohms).

The second antenna 5 is used to generate a second resonant mode to cover the PCS 900 operating bandwidth, and includes a second radiation unit 51 and a second grounding portion 52. The second radiation unit 51 includes a second feed-in portion 511, a second short circuit portion 512, a first radiation arm 513 and a second radiation arm 514. The first radiation arm 513 is disposed on the first surface 21 of the substrate 2, extends from the second short circuit portion 512 away from the second grounding portion 52, and has a free end 5131. The second radiation arm 514 is disposed on the second surface 22 of the substrate 2, extends from the second feed-in portion 511 away from the second grounding portion 52, and is electrically coupled to the first radiation arm 513 disposed on the first surface 21 through the third conductive vias 25. The first and second grounding portions 42, 52 cooperatively constitute a grounding unit 7 disposed on the first surface 21 of the substrate 2. The grounding unit 7 is a metal plate that has an edge 71, which defines a border line. The first and second radiation units 41, 51 are disposed spacedly and generally at one side of the border line opposite to the grounding unit 7. By rearranging the position of a junction between the second radiation arm 514 and the first radiation arm 513, an input resistance $R_2$ of the second antenna 5 measured from the second feed-in portion 511 can be adjusted. In the first preferred embodiment, the input resistance $R_2$ is set to be substantially double of the resistance of the coaxial cable 31 (i.e. 100 ohms).

The second surface 22 of the substrate 2 is formed with a microstrip that serves as the transmission line 6, which includes a first connecting portion 61 and a second connecting portion 62. The first connecting portion 61 is electrically coupled to the first feed portion 32 of the feed unit 3, and the second connecting portion 62 is electrically coupled to the second feed-in portion 511 of the second antenna 5. The transmission line 6 extends to have a length substantially equal to one quarter of the wavelength that corresponds to a central frequency of the operating bandwidth. The resistance $R_T$ of the transmission line 6 is determined by the input resistance $R_1$ of the first antenna 4 and the input resistance $R_2$ of the second antenna 5 with the formula as follows.

$$R_T=\sqrt{R_1 \times R_2}$$

Therefore, in the first preferred embodiment, the resistance $R_T$ of the transmission line 6 is substantially 100 ohms.

Referring to FIGS. 2 to 5, the antenna assembly 20 can be fastened to a back plate 8 (such as to the back of a tablet computer) including a grounding portion 81. The fastening holes 26 of the substrate 2 are disposed along the edge 71 of the grounding unit 7 and are spaced apart from each other. The fourth conductive vias 27 in each group are disposed to surround the corresponding one of the fastening holes 26 and are electrically coupled to the grounding unit 7 and the corresponding one of the metal rings 28. The fastening holes 26 allow the substrate 2 to be fastened to the back plate 8 by extending a fastener 82 through each of the fastening holes 26 and through the back plate 8, such that the grounding unit 7 of the antenna assembly 20 is in electrical contact with the grounding portion 81 of the back plate 8. In this embodiment, the dimension of the grounding portion 81 is 19×13 $cm^2$.

Figure 5:
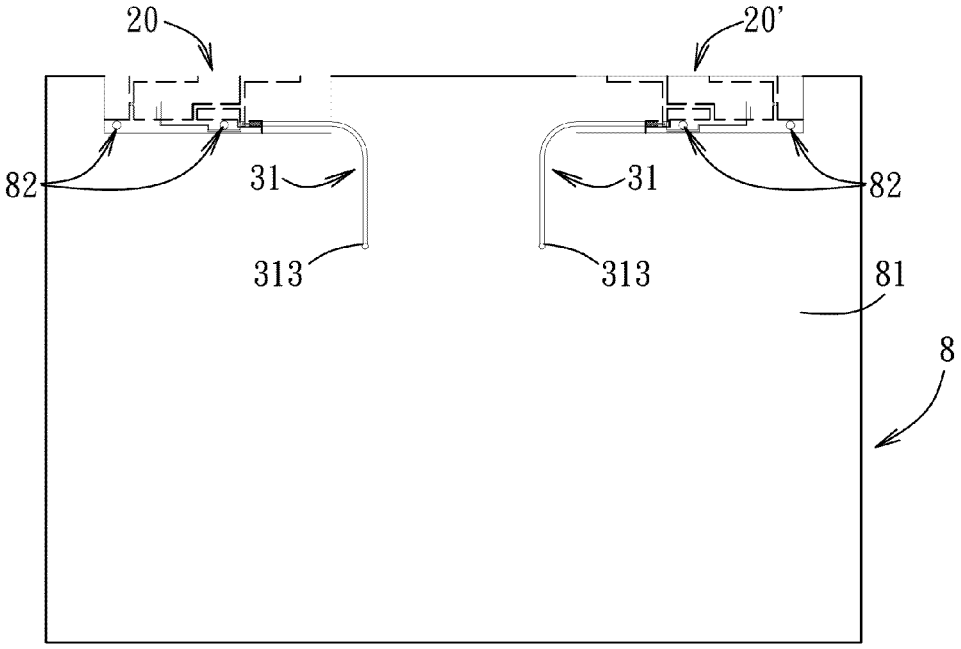
FIG. 5 is a schematic drawing of the first preferred embodiment where the substrate is fastened to a back plate.
Figure 6:
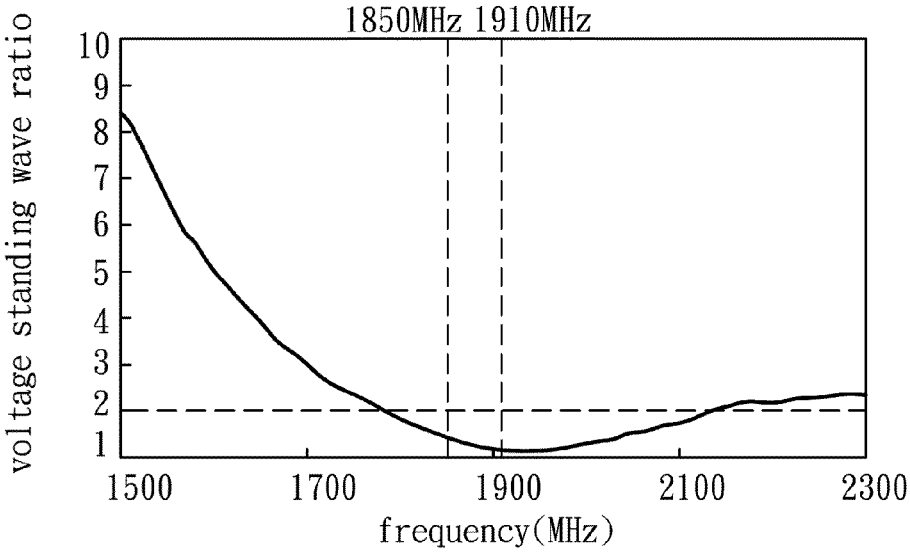
FIG. 6 is a plot showing a voltage standing wave ratio measured for the first preferred embodiment.

Referring to FIGS. 5 and 6, where FIG. 5 shows two antenna assemblies fastened to the back plate 8, and FIG. 6 is a plot of the voltage standing wave ratio (VSWR) measured from a connector 313 of the coaxial cable 31 of one of the antenna assemblies 20. The plot in FIG. 6 shows the antenna assembly 20 of the present invention having a good impedance matching by having VSWR<2 in the operating bandwidth of PCS 900.

Figure 7:
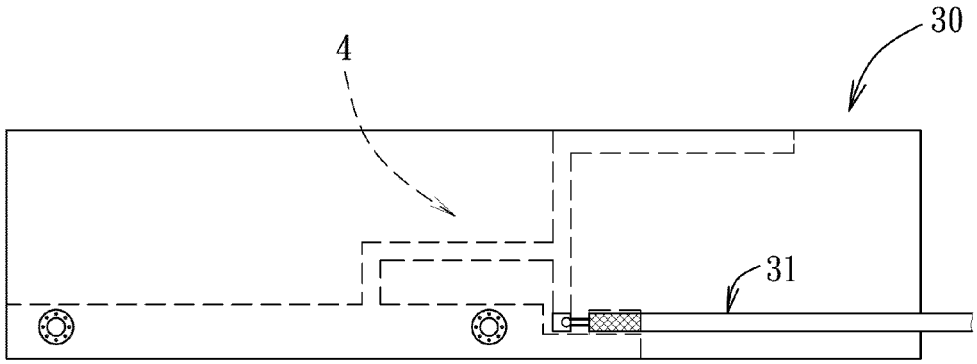
FIG. 7 is a schematic drawing of a single antenna configuration.

FIG. 7 shows a single antenna configuration 30, which is an antenna assembly that does not include the transmission line 6 and the second radiation unit 51 of the second antenna 5 of the antenna assembly 20 of the first preferred embodiment according to the present invention (see FIG. 4). The input resistance $R_1$ of the single antenna configuration 30 is adjusted to be 50 ohms to match with the 50-ohm coaxial cable 31. The single antenna configuration 30 is taken as a reference to be compared with the antenna assembly 20 of the present invention.

Figure 12:
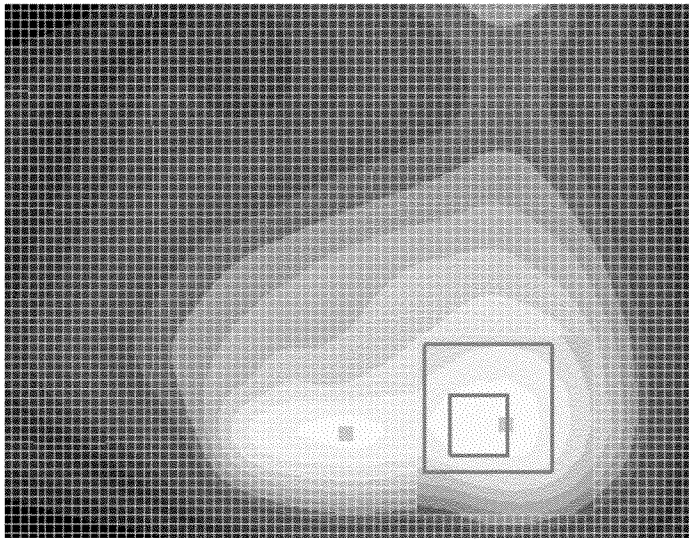
FIG. 12 shows result of a simulation of SAR intensity distribution of the antenna assembly.
Figure 13:
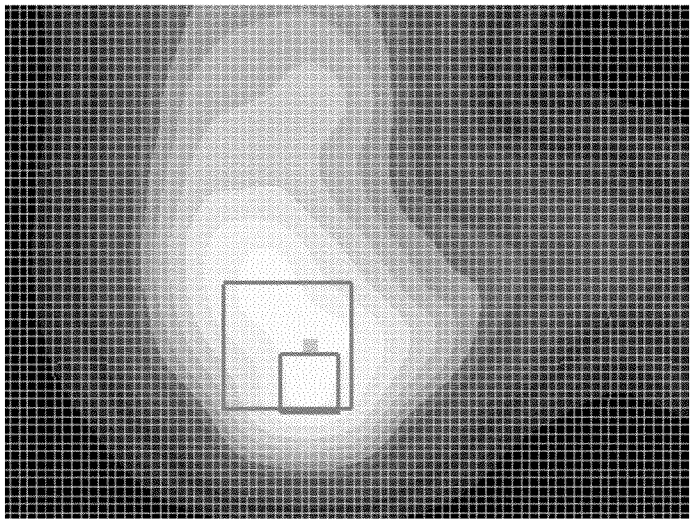
FIG. 13 is shows result of a simulation of SAR intensity distribution of the single antenna configuration of FIG. 7.

FIGS. 12 and 13 respectively show SAR intensity distributions of the antenna assembly 20 (FIG. 4) and the single antenna configuration 30 (FIG. 7) as simulated using a software known as SEMCAD (simulation platform for electromagnetic compatibility, antenna Design and Dosimetry) of DASY4 (Dosimetric assessment system) from SPEAG (Schmid and Partner Engineering AG). From the comparison of the two figures, the energy of signals transmitted via the antenna assembly 20 of the present invention is more distributed than that via the single antenna configuration 30. Therefore, it is obvious that due to the more distributed energy of the transmitted signal, the antenna assembly 20 of the present invention is effective in reducing SAR as compared to the single antenna configuration 30.

Table 1 lists the actual measurements of the radiation efficiency, the total radiation power, SAR per 1 mg volume, and average SAR per 10 mg volume for the antenna assembly 20 and the single antenna configuration 30.

TABLE 1

| | Frequency (MHz) | Radiation Efficiency (dB) | Total Radiation Power (dBm) | SAR per 1 mg volume (mW/g) | Average SAR per 10 mg volume (mW/g) |
|---|---|---|---|---|---|
| Antenna assembly 20 of the present invention | 1850 | −2.0 | 22.6 | 1.34 | 0.65 |
| | 1880 | −1.7 | 23.0 | 1.40 | 0.74 |
| | 1910 | −1.5 | 22.9 | 1.30 | 0.63 |
| Single antenna configuration 30 (Reference) | 1850 | −2.1 | 22.4 | 3.84 | 1.82 |
| | 1880 | −1.8 | 22.8 | 4.10 | 2.08 |
| | 1910 | −1.9 | 22.7 | 3.70 | 1.71 |

Table 1 shows that the SAR per 1 mg volume and the average SAR per 10 mg volume for the antenna assembly 20 of the present invention and the single antenna configuration 30 were measured under nearly identical radiation efficiency and total radiation power to eliminate bias from power loss or impedance mismatching and to demonstrate a more controlled comparison. The SARs of the antenna assembly 20 within the system bandwidth of PCS 900 are below the regulation of 1.6 mW/g. Therefore the antenna assembly 20 is suitable for use in communication products in countries adopting such regulation.

Figure 8:
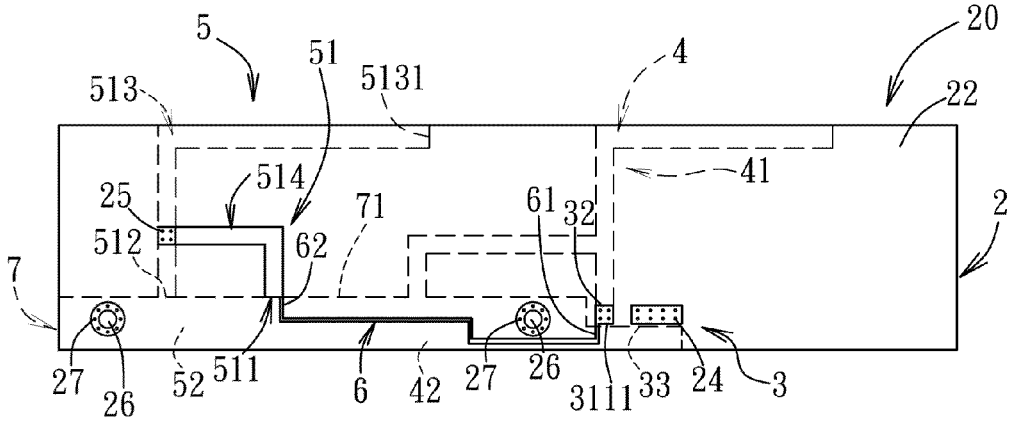
FIG. 8 is a schematic drawing of the second preferred embodiment of an antenna assembly according to the present invention, illustrating the omission of a coaxial cable in the second preferred embodiment.

FIG. 8 shows the second preferred embodiment of an antenna assembly 20 of the present invention. The second preferred embodiment includes everything in the first preferred embodiment apart from the coaxial cable 31.

Figure 9:
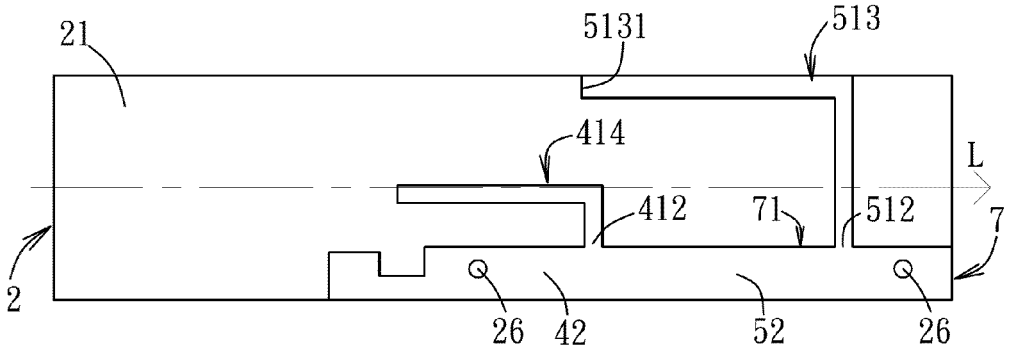
FIG. 9 is a schematic drawing of a first surface of a substrate of the third preferred embodiment of the antenna assembly according to the present invention.
Figure 10:
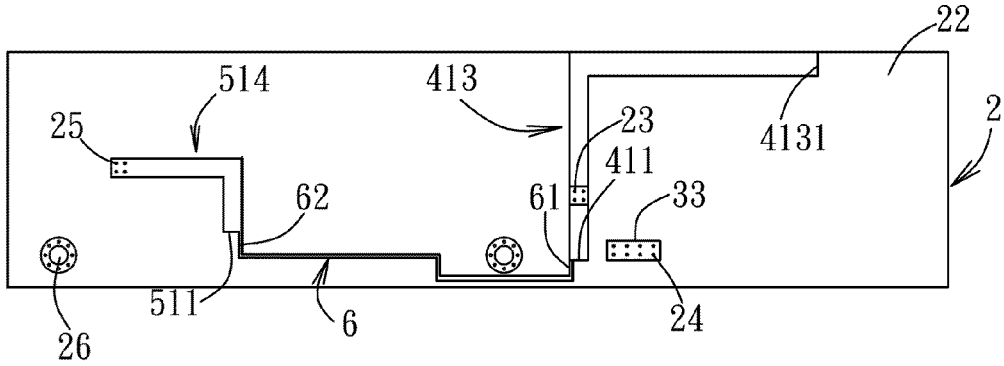
FIG. 10 is a schematic drawing of a second surface of the substrate of the third preferred embodiment.
Figure 11:
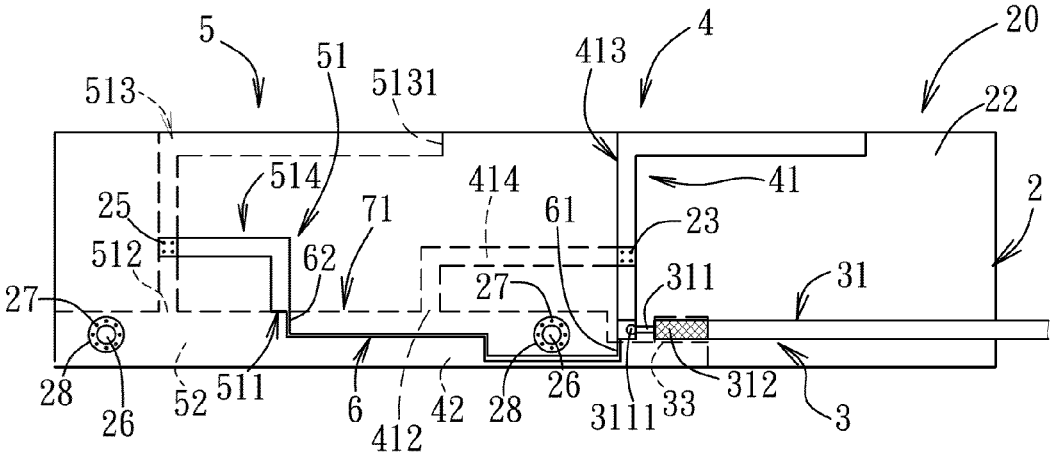
FIG. 11 is a schematic drawing of the third preferred embodiment.

FIGS. 9 to 11 show the third preferred embodiment of an antenna assembly 20 of the present invention. The differences between the third preferred embodiment and the first preferred embodiment reside in the structure of the first antenna 4, and the connection configurations of the first antenna 4 to the feed unit 3 and to the transmission line 6. Therefore, the following description describes the structure and connection configurations of the first antenna 4, and for the rest of the third preferred embodiment, please refer to the above descriptions of the first preferred embodiment with reference to FIGS. 2 to 4.

The first antenna 4 is used to generate a first resonant mode to cover a personal communication service (PCS) 900 operating bandwidth (1850 to 1990 MHz), and includes a first radiation unit 41 and a first grounding portion 42. The first radiation unit 41 includes a first feed-in portion 411, a first short circuit portion 412, a first radiation arm 413 and a second radiation arm 414. The first short circuit portion 412 is electrically coupled to the first grounding portion 42. The first radiation arm 413 is disposed on the second surface 22 of the substrate 2, extends from the first feed-in portion 411 away from the first grounding portion 42, and has a free end 4131. The second radiation arm 414 is disposed on the first surface 21 of the substrate 2, extends from the first short circuit portion 412 away from the first grounding portion 42, and is electrically coupled to the first radiation arm 413 through a plurality of first conductive vias 23 that extend through the first and second surfaces 21, 22 of the substrates 2. Instead of providing the feed unit 3 with the first feed portion 32 in electrical contact with the first conductive vias 23 as in the first preferred embodiment to couple electrically the first feed-in portion 411 and the end 3111 of the core wire 311 of the coaxial cable 31, the first feed-in portion 411 of the third preferred embodiment is in direct contact with the end 3111 of the core wire 311 of the coaxial cable 31. The conductive shielding layer 312 of the coaxial cable 31 and the second feed unit 33 disposed on the second surface 22 are in electrical contact with the grounding portion 42 through the second conductive vias 24. By rearranging the position of a junction between the second radiation arm 414 and the first radiation arm 413, an input resistance $R_1$ of the first antenna 4 measured from the first feed-in portion 411 can be adjusted. In the third preferred embodiment, the input resistance $R_1$ is set to be substantially double of the resistance of the coaxial cable 31 (i.e. 100 ohms). Furthermore, the first connecting portion 61 of the transmission line 6 in the third preferred embodiment is in direct electrical contact with the first feed-in portion 411 of the first antenna 4.

From the above, when a signal within the PCS 900 operating bandwidth is transmitted through the coaxial cable 31 to the rest of the antenna assembly 20, the energy of the signal is distributed among the first and second antennas 4, 5 to reduce the SAR of the antenna assembly 20, thereby achieving the object of the invention.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An antenna assembly able to reduce specific absorption rate, comprising:

a feed unit including a coaxial cable that includes a core wire and a conductive shielding layer, and a first feed portion and a second feed portion that are spaced apart from each other, said first feed portion being in contact with said core wire, said second feed portion being in contact with said conductive shielding layer;

a first antenna to generate a first resonant mode to cover an operating bandwidth and including a first radiation unit and a first grounding portion, said first radiation unit including a first feed-in portion electrically coupled to said first feed portion of said feed unit, said first grounding portion being electrically coupled to said second feed portion of said feed unit;

a second antenna to generate a second resonant mode to cover the operating bandwidth and including a second radiation unit and a second grounding portion, said second radiation unit including a second feed-in portion; and a transmission line including a first connecting portion and a second connecting portion, said first connecting portion being electrically coupled to said first feed portion of said feed unit, said second connecting portion being electrically coupled to said second feed-in portion of said second antenna;

whereby, when a signal within the operating bandwidth is transmitted through said coaxial cable, the energy of the signal is distributed among said first and second antennas.

2. The antenna assembly as claimed in claim 1, wherein said first radiation unit of said first antenna further includes a first short circuit portion electrically coupled to said first grounding portion, and said second radiation unit of said second antenna further includes a second short circuit portion electrically coupled to said second grounding portion.

3. The antenna assembly as claimed in claim 2, wherein said first and second grounding portions cooperatively constitute a grounding unit which is a metal plate that has an edge, said edge defining a border line, said first and second radiation units being disposed spacedly and generally at one side of said border line opposite to said grounding unit.

4. The antenna assembly as claimed in claim 3, further comprising a substrate that includes opposite first and second surfaces, and a first conductive via and a second conductive via, each of which extends through said first and second surfaces, said feed unit being disposed on said second surface, said grounding unit and said first radiation unit being disposed on said first surface, said first feed-in portion of said first radiation unit being electrically coupled to said first feed portion of said feed unit through said first conductive via, said grounding unit being electrically coupled to said second feed portion of said feed unit through said second conductive via.

5. The antenna assembly as claimed in claim 4, wherein said first radiation unit further includes a first radiation arm and a second radiation arm, said first radiation arm extending from said first feed-in portion away from said first grounding portion and having a free end, said second radiation arm extending from said first short circuit portion away from said first grounding portion and being electrically coupled to said first radiation arm.

6. The antenna assembly as claimed in claim 5, wherein said substrate further includes a third conductive via extending through said first and second surfaces, said second radiation unit further including a first radiation arm disposed on said first surface, and a second radiation arm disposed on said second surface, said first radiation arm extending from said second short circuit portion away from said second grounding portion and having a free end, said second radiation arm extending from said second feed-in portion away from said second grounding portion and being electrically coupled to said first radiation arm of said second radiation unit through said third conductive via.

7. The antenna assembly as claimed in claim 4, wherein said substrate is formed on said second surface with a microstrip that serves as said transmission line, said transmission line extending to have a length substantially equal to one quarter of a wavelength that corresponds to a central frequency of the operating bandwidth.

8. The antenna assembly as claimed in claim 4, wherein said substrate is formed therethrough with a fastening hole that allows said substrate to be fastened to a back plate, which includes a grounding portion, by extending one fastener through said fastening hole and the back plate such that said grounding unit of said antenna assembly is in electrical contact with the grounding portion of the back plate.

9. The antenna assembly as claimed in claim 8, wherein said substrate further includes a metal ring disposed on said second surface of said substrate to correspond to said fastening hole, and a fourth conductive via extending through said first and second surfaces and electrically coupled to said metal ring and said grounding unit.

10. An antenna assembly able to reduce specific absorption rate, and adapted for use in signal transmission with a system circuit through a coaxial cable, said antenna assembly comprising:

a first antenna to generate a first resonant mode to cover an operating bandwidth and including a first radiation unit and a first grounding portion, said first radiation unit including a first feed-in portion in electrical contact with a core wire of the coaxial cable, said first grounding portion being electrically coupled to a conductive shield layer of the coaxial cable;

a second antenna to generate a second resonant mode to cover the operating bandwidth and including a second radiation unit and a second grounding portion, said second radiation unit including a second feed-in portion; and a transmission line including a first connecting portion and a second connecting portion, said first connecting portion being electrically coupled to said first feed-in portion of said first antenna, said second connecting portion being electrically coupled to said second feed-in portion of said second antenna;

whereby, when a signal within the operating bandwidth is transmitted through the coaxial cable, the energy of the signal is distributed among said first and second antennas.

11. The antenna assembly as claimed in claim 10, wherein said first grounding portion is electrically coupled to said second grounding portion, said first radiation unit of said first antenna further includes a first short circuit portion electrically coupled to said first grounding portion, and said second radiation unit of said second antenna further includes a second short circuit portion to be electrically coupled to said second grounding portion.

* * * * *